US008334833B2

(12) United States Patent
Pankaj et al.

(10) Patent No.: US 8,334,833 B2
(45) Date of Patent: Dec. 18, 2012

(54) BACKLIGHT UNIT AND DISPLAY APPARATUS HAVING THE SAME

(75) Inventors: Agarwal Pankaj, Suwon-si (KR); Joon-hyun Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1185 days.

(21) Appl. No.: 11/941,422

(22) Filed: Nov. 16, 2007

(65) Prior Publication Data

US 2009/0021468 A1 Jan. 22, 2009

(30) Foreign Application Priority Data

Jul. 19, 2007 (KR) ..... 10-2007-0072074

(51) Int. Cl.
*G09G 3/36* (2006.01)

(52) U.S. Cl. ..... 345/102

(58) Field of Classification Search ..... 345/76, 345/72, 87, 102, 82
See application file for complete search history.

(56) References Cited

U.S. PATENT DOCUMENTS

2006/0256049 A1 11/2006 Schou

FOREIGN PATENT DOCUMENTS

EP 0687057 A 12/1995
WO 2007141732 A2 12/2007

*Primary Examiner* — Regina Liang
(74) *Attorney, Agent, or Firm* — Sughrue Mion, PLLC

(57) ABSTRACT

A display apparatus, includes: a display unit which displays a video; a light source unit having a plurality of light sources which are independently driven, and which illuminate the display unit; and a driving unit which drives the light source unit. The driving unit includes: a driving signal generating unit which generates a driving signal which has a first voltage level and a second voltage level so that the plurality of light sources can be independently driven, and a control unit which blocks or applies the driving signal to drive the light source unit based on a voltage level which is applied to the light source unit if the driving signal which is generated by the driving signal generating unit is the first voltage level.

16 Claims, 5 Drawing Sheets

BACKLIGHT UNIT AND DISPLAY APPARATUS HAVING THE SAME

CROSS-REFERENCE TO RELATED PATENT APPLICATIONS

This application claims priority from Korean Patent Application No. 10-2007-0072074, filed on Jul. 19, 2007 in the Korean Intellectual Property Office, the disclosure of which is incorporated herein by reference in its entirety.

BACKGROUND OF THE INVENTION

1. Field of the Invention

A backlight unit and a display apparatus having the same consistent with the present invention relate to emitting, in sequence, light sources.

2. Description of the Related Art

Recently, as various demands for a display apparatus increases, various flat panel display apparatuses such as a liquid crystal display (LCD), a plasma display panel (PDP), an electro luminescent display (ELD), and a vacuum fluorescent display (VFD), etc. have been used. Especially, among these flat panel display apparatuses, a display apparatus using a liquid crystal panel has been used widely because the display apparatus is capable of operating under low electric power, and has a superior display property.

However, since the display apparatus using the liquid crystal panel is a non-emissive type, and only adjusts the amount of light transmitting a liquid crystal, the display apparatus needs a light source supplying a uniform light to a total screen.

In general, a cathode fluorescent lamp emitting a white light such as a cold cathode fluorescent lamp (CCFL), a hot cathode fluorescent lamp (HCFL), or the like can be used as the light source.

When the display apparatus using the liquid crystal panel is employed for a television to mainly display a moving image, a slow response speed of the liquid crystal causes a blurring phenomenon that a boundary of the image is unclear and hazily displayed.

Accordingly, a conventional scanning-type display apparatus may be used which employs a scanning method of driving a lot of lamps in sequence to correspond to a response speed of the liquid crystal to improve the blurring phenomenon generated in the image.

In the conventional scanning-type apparatus, a backlight unit includes a lot of lamps positioned facing a rear surface of the liquid crystal panel and connected in parallel. Generally, herein a plurality of lamps refer to a single unit block, and a large number of lamps refers to n unit blocks from a first block to an Nth block.

Also, n scanning signals having a predetermined frequency (for example, 60 Hz to 120 Hz) are generated to drive the backlight unit so that the lamps provided to the n unit blocks can be respectively turned on and off in sequence.

In general, the scanning signal is generated by a digital circuit such as a field programmable gate array (FPGA), a microcomputer integrated circuit, or the like. Accordingly, to drive the lamps of the backlight unit based on the scanning signal of the digital signal, a digital circuit such as the FPGA or the microcomputer integrated circuit is needed. However, the digital circuit has a complicated configuration, and the cost of the component is high, which increases the ultimate cost of the product.

SUMMARY OF THE INVENTION

Accordingly, exemplary embodiments of the invention may provide a backlight unit and a display apparatus having the same using a simple and inexpensive analogue circuit in driving a plurality of light sources provided to a backlight unit in sequence to prevent a motion blurring phenomenon.

The present invention also provides a backlight unit, and a display apparatus having the same, appropriately generating, through a simple analogue circuit, a scanning signal having a waveform in addition to a scanning signal having a previously programmed waveform.

According to an aspect of the present invention, there is provided a display apparatus, including: a display unit which displays a video; a light source unit which includes a plurality of light sources which are independently driven, and which illuminate the display unit; and a driving unit which drives the light source unit. The driving unit includes: a driving signal generating unit which generates a driving signal having a first voltage level and a second voltage level so that the plurality of light sources can be independently driven, and a control unit which blocks or applies the driving signal to drive the light source unit based on a voltage level which is applied to the light source unit if the driving signal which is generated by the driving signal generating unit is the first voltage level.

The control unit may include a diode unit which blocks the driving signal to drive the light source unit based on the voltage level which is applied to the light source unit if the driving signal is the first voltage level.

The diode unit may include a reverse direction diode which is disposed between the driving signal generating unit and the driving unit, and which blocks the driving signal to drive the light source unit based on the voltage level which is applied to the light source unit if the first voltage level of the driving signal is a high level.

The diode unit may include a forward direction diode which is disposed between the driving signal generating unit and the driving unit, and which blocks the driving signal to drive the light source unit based on the voltage level which is applied to the light source unit if the first voltage level of the driving signal is a low level.

The diode unit may include the same number of diodes as the light sources which are provided to the light source unit.

The plurality of light sources may be arranged in a matrix shape.

According to another aspect of the present invention, there is provided a backlight unit, including: a light source unit which includes a plurality of light sources which are independently driven; and a driving unit which drives the light source unit. The driving unit includes: a driving signal generating unit which generates a driving signal having a first voltage level and a second voltage level so that the plurality of light sources can be independently driven, and a control unit which blocks or applies the driving signal to drive the light source unit based on a voltage level which is applied to the light source unit if the driving signal which is generated by the driving signal generating unit is the first voltage level.

The control unit may include a diode unit which blocks the driving signal to drive the light source unit based on the voltage level which is applied to the light source unit if the driving signal is the first voltage level.

The diode unit may include a reverse direction diode which is disposed between the driving signal generating unit and the driving unit, and which blocks the driving signal to drive the light source unit based on the voltage level which is applied to the light source unit if the first voltage level of the driving signal is a high level.

The diode unit may include a forward direction diode which is disposed between the driving signal generating unit and the driving unit, and exemplary blocks the driving signal to drive the light source unit based on the voltage level which is applied to the light source unit if the first voltage level of the driving signal is a low level.

The diode unit may include the same number of diodes as the light sources which are provided to the light source unit.

The plurality of light sources may be arranged in a matrix shape.

BRIEF DESCRIPTION OF THE DRAWINGS

The above and/or other exemplary aspects of the present invention will become apparent and more readily appreciated from the following description of the exemplary embodiments, taken in conjunction with the accompanying drawings, in which.

DETAILED DESCRIPTION OF EXEMPLARY EMBODIMENTS OF THE INVENTION

Figure 1:
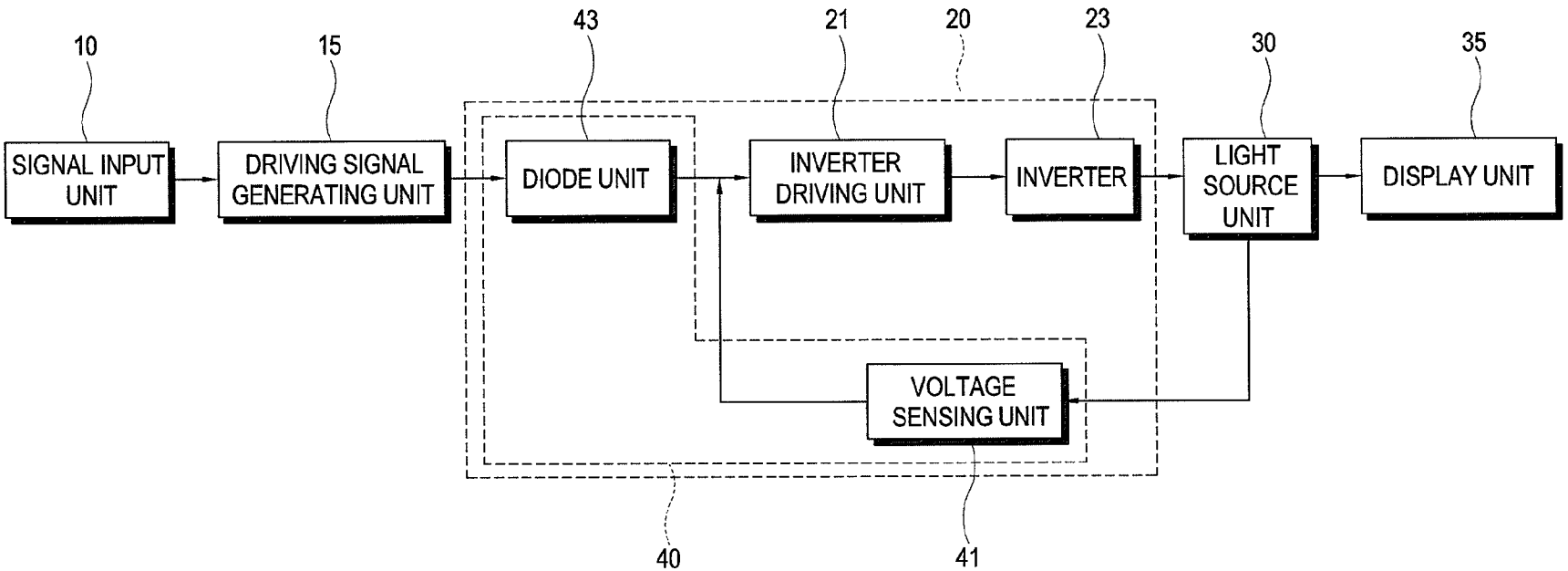
FIG. 1 is a control block diagram of a display apparatus according to an exemplary embodiment of the present invention.

Reference will now be made in detail to the embodiments of the present invention, examples of which are illustrated in the accompanying drawings, wherein like reference numerals refer to like elements throughout. The exemplary embodiments are described below so as to explain the present invention by referring to the figures.

FIG. 1 is a control block diagram of a display apparatus according to an exemplary embodiment of the present invention. As shown in FIG. 1, the display apparatus according to this exemplary embodiment of the present invention includes a signal input unit 10, a driving signal generating unit 15, a driving unit 20 including a control unit 40, a light source unit 30, and a display unit 35. The driving unit 20 and the light source unit 30 may be provided as a backlight unit.

The signal input unit 10 according to this exemplary embodiment of the present invention receives a video or image signal, and includes a tuner (not shown) receiving a broadcasting signal, and an external connection terminal (not shown) for receiving a video or image signal from an external device.

Here, the external connection terminal may include a connector of various types so that the video signal of various formats can be received. For example, the signal input unit 10 may include at least one of a D-sub connector, a composite video baseband signal (CVBS) connector, an S-video connector and a component connector to receive the video signal.

The light source unit 30 illuminates the display unit 35 displaying a video or image, and is provided with a plurality of light sources to be independently driven. Also, the plurality of light sources may be arranged in a matrix shape. That is, the light source unit 30 may include a plurality of unit blocks each of which is provided with one or more light sources equally driven. The unit blocks are positioned from a first block to an Nth block in sequence.

The light source according to the present exemplary embodiment may be provided as a light emitting diode (LED), and is uniformly distributed to a whole surface of a light emitting diode circuit board (not shown) positioned at a rear surface of the display unit 35. The light source may include a light emitting diode unit emitting red, green and blue light, or may further include a white light emitting diode.

The type of the light source is not limited to the light emitting diode. The light source may be provided as a cold cathode fluorescent lamp (CCFL), a laser diode, an oxygen nanotube, or the like as would be understood by one of skill in the art.

The driving unit 20 applies a driving voltage for driving the light source unit 30, and includes a first driving unit to an Nth driving unit for driving the light source of the first block to the Nth block.

The driving unit 20 according to the present exemplary embodiment includes the driving signal generating unit 15, an inverter driving unit 21 and the control unit 40.

The driving signal generating unit 15 generates a driving signal having a frequency of 60 Hz to 120 Hz, and applies the driving signal to the driving unit 20 to drive the light source unit 30, and may be provided as an FPGA, or the like.

Figure 2:
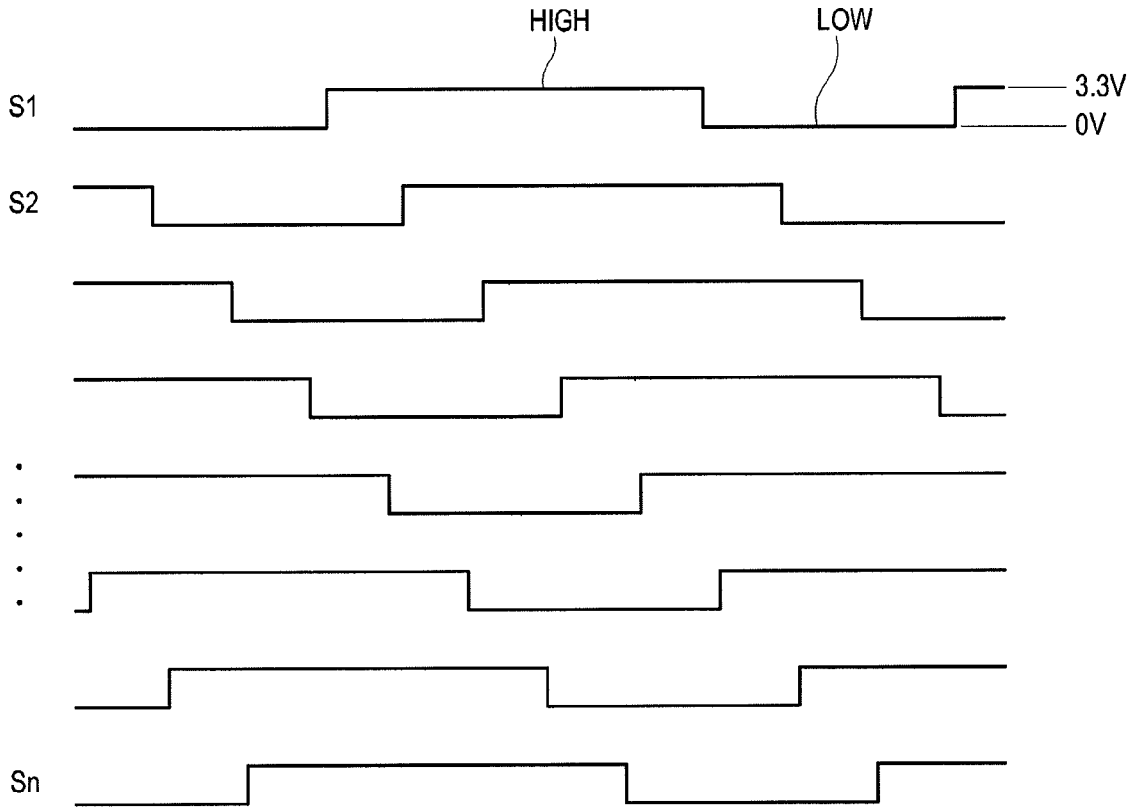
FIG. 2 illustrates a driving signal generated by a driving signal generating unit according to an exemplary embodiment of the present invention.

Here, as shown in FIG. 2, in the driving signal generated by the driving signal generating unit 15 according to the present exemplary embodiment, a first voltage level and a second voltage level are repeated. In the driving signal according to the present exemplary embodiment, n (S1, S2, . . . ) driving signals are generated in sequence so that a high signal having the first voltage level (3.3 V) and a low signal having the second voltage level (0V) can correspond to each unit block provided to the light source unit 30.

Here, the driving signal generating unit 15 may generate the driving signal having a different frequency according to the video signal inputted through the signal input unit 10. For example, the driving signal generating unit 15 may generate the driving signal having a frequency of 60 Hz if a frame in the input video signal has a lot of motion, and generate the driving signal having a frequency of 120 Hz if the frame does not have a lot of motion.

Figure 3:
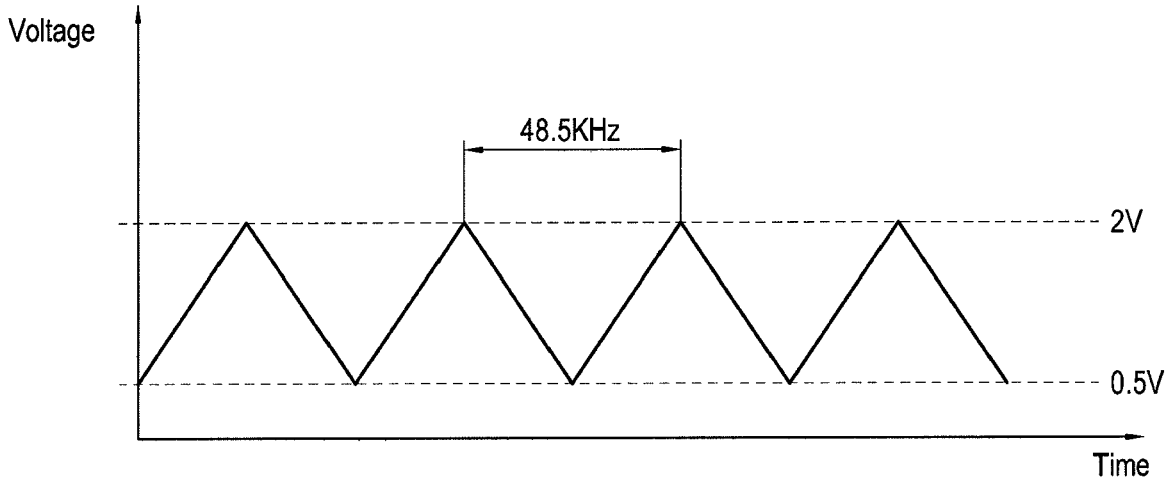
FIG. 3 is a circuit diagram illustrating a driving unit according to an exemplary embodiment of the present invention.

The inverter driving unit 21 drives an inverter 23 based on a triangular waveform shown in FIG. 3 so that the inverter 23 can apply a uniform driving voltage to the light source unit 30. The triangular waveform has a frequency of 48.5 KHz, and the high level is 2 V and the low level is 0.5 V. However, the exemplary embodiments of this invention are not limited to these specific frequencies and voltages.

The inverter driving unit 21 compares a voltage level sensed by a voltage sensing unit 41 with the triangular waveform to drive the inverter 23. That is, for example, if the voltage level sensed by the voltage sensing unit 41 is bigger than 2 V, the inverter driving unit 21 drives the inverter 23 so that duty ratio (ratio of turned-off to turned-on) of the light source unit 30 can be bigger than 90%. Further, for example, if the voltage level is smaller than 0.5 V, the inverter driving unit 21 drives the inverter 23 so that the duty ratio of the light source unit 30 can be 0%.

Also, the inverter 23 controls the brightness of a light emitted from the light source unit 30 under a control of the inverter driving unit 21 to adjust the brightness of an image displayed in the display unit 35.

The control unit 40 blocks or applies the driving signal to drive the light source unit 30 based on the voltage level applied to the light source unit 30 if the voltage level of the driving signal generated by the driving signal generating unit 15 is the first voltage level, and includes a diode unit 43 and the voltage sensing unit 41. The control unit 40 according to the present exemplary embodiment includes a first control unit to an Nth control unit for controlling the first driving unit to the Nth driving unit.

The voltage sensing unit 41 senses the voltage level applied to the light source unit 30, and is connected between the diode unit 43 and the driving unit 20 to feed back the sensed voltage level.

The diode unit 43 is opened or closed depending on the voltage level of the driving signal, and may be provided as a reverse direction diode.

In detail, since the diode unit 43 according to the present exemplary embodiment is a reverse direction diode, if the voltage level of the driving signal is higher than the voltage level sensed by the voltage sensing unit 41, the diode unit 43 is opened. Accordingly, the voltage level of the driving signal does not flow to the driving unit 20, and the driving unit 20 compares the voltage level sensed by the voltage sensing unit 41 with the triangular waveform to drive the light source unit 30 to emit light.

Also, if the voltage level of the driving signal is lower than the voltage level sensed by the voltage sensing unit 41, the diode unit 43 is connected. Accordingly, the voltage level sensed by the voltage sensing unit 41 flows through the diode unit 43, and the voltage level sensed by the voltage sensing unit 41 becomes 0V so that driving unit 20 can make the light source unit 30 not emit light.

Hereinafter, the display apparatus according to the present exemplary embodiment of the present invention will be described in more detail by referring to a circuit diagram in FIG. 4.

Figure 4:
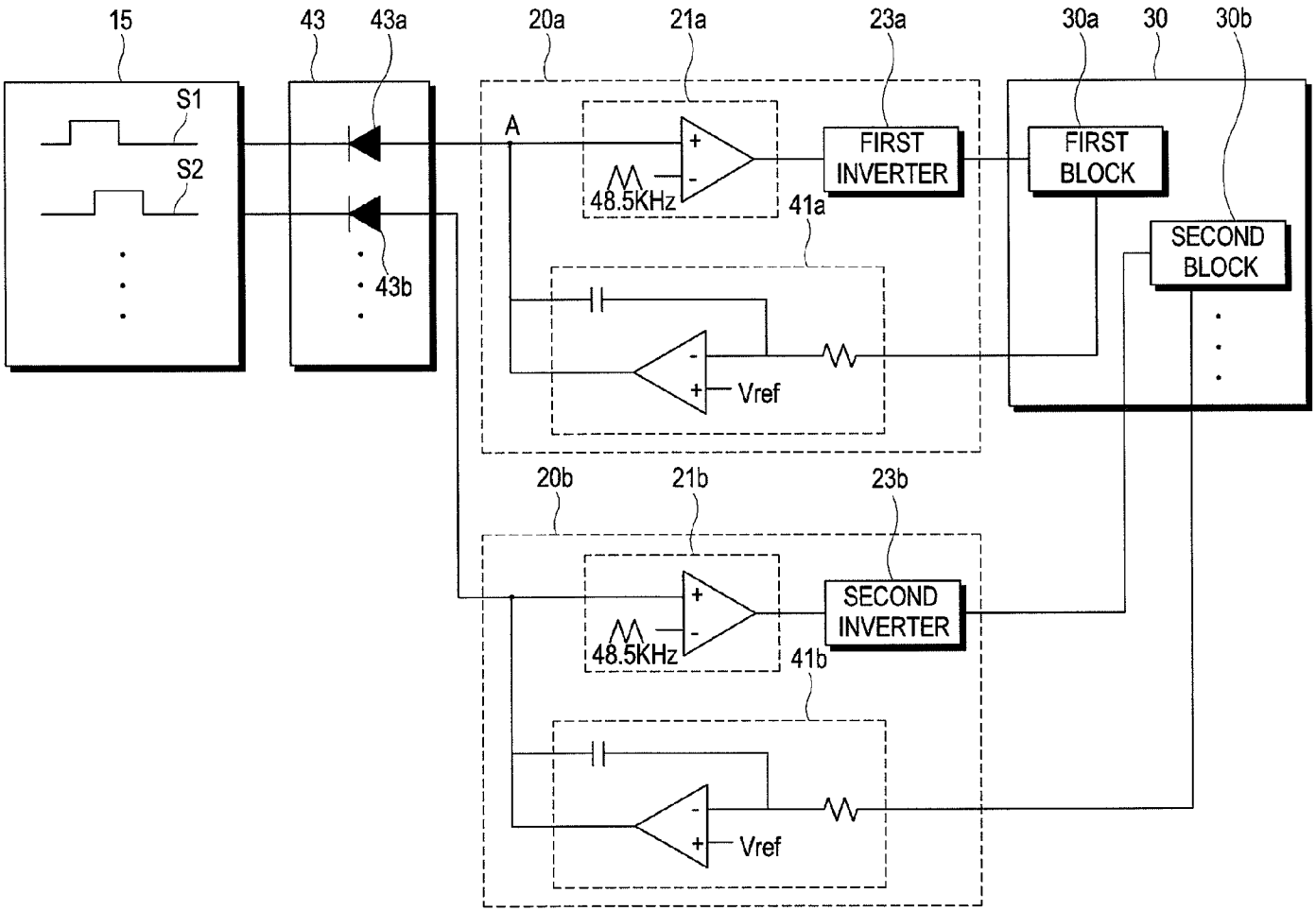
FIG. 4 illustrates a triangular waveform according to an exemplary embodiment of the present invention.

As shown in FIG. 4, the driving signal generating unit 15 generates n driving signals S1, S2, . . . Sn having high and low levels. If a first driving signal S1 is generated, a first diode 43*a* is applied with the first driving signal S1, and compares this signal with the voltage level sensed by a first voltage sensing unit 41*a*. Here, since the sensed voltage level is fed back to be applied to a connection point A, the first diode 43*a* compares the voltage level of the first driving signal a with the voltage level applied to the connection point A.

If the first driving signal a is the high level, since the voltage level is 3.3 V, and higher than the voltage level 0.5 V to 2.0 V applied to the connection point A, the first diode 43*a* is opened. Accordingly, a first inverter driving unit 21*a* compares the voltage level applied to the connection point A with the triangular waveform to drive a first inverter 23*a* so that a driving power can be applied to the light source provided to a first block 30*a*.

Also, if the first driving signal a is the low level, since the voltage level is 0V, and lower than the voltage level applied to the connection point A, the first diode 43*a* is connected. Accordingly, since the voltage level applied to the connection point A flows to the driving signal generating unit 15, and the connection point A becomes 0V, the first inverter driving unit 21*a* makes the driving power not be applied to the first block 30*a*.

Like this, if a second driving signal S2 is generated, a second diode 43*b* compares the voltage level of the second driving signal S2 with the voltage level sensed by a second voltage sensing unit 41*b* and applied to the connection point A, thereby to be opened or connected. Also, as the second diode 43*b* is opened or connected, a second inverter driving unit 21*b* drives a second inverter 23*b* so that the driving power can be applied or blocked to a second block 30*b*.

Figure 5:
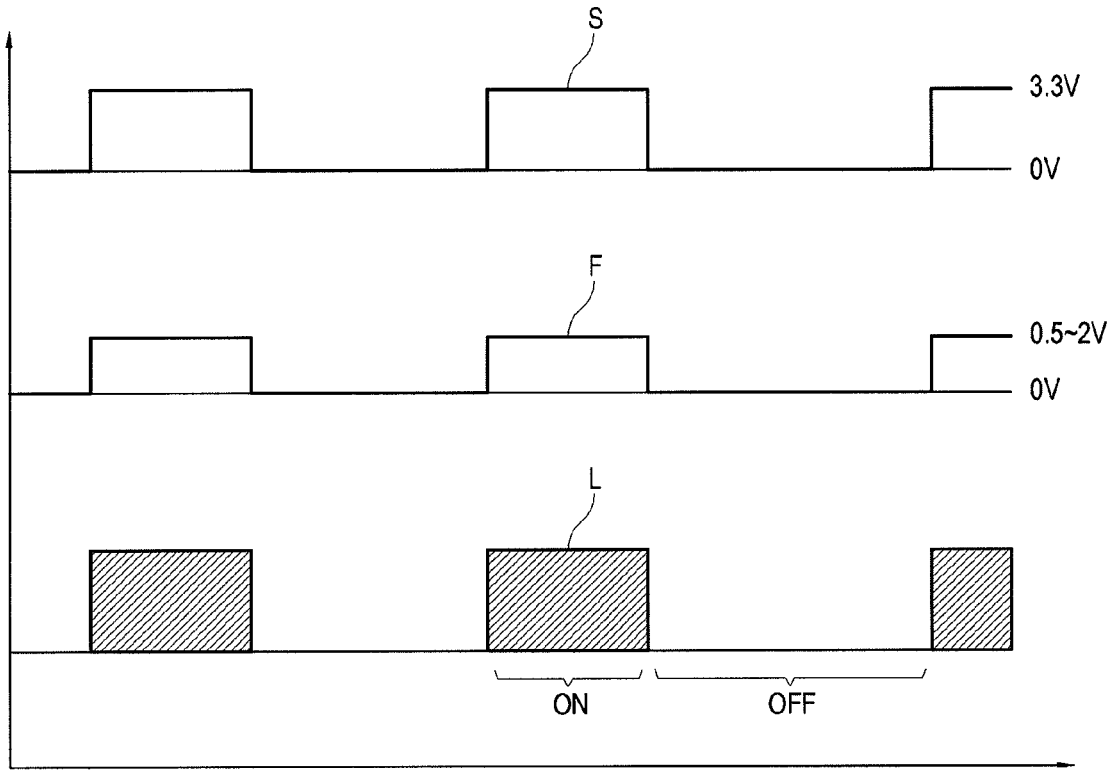
FIG. 5 illustrates emission of a light source unit depending on a driving signal generated according to an exemplary embodiment of the present invention.

FIG. 5 illustrates whether the light source unit 30 emits light depending on the driving signal according to the present exemplary embodiment. Referring to FIG. 5, If the voltage level of the generated driving signal S is the high level, the voltage level F of the fed back connection point A increases, and the driving power is applied to the light source unit 30 so that the light source unit 30 can emit light.

Also, if the voltage level of the generated driving signal S is the low level, the driving power is blocked so that the light source unit 30 can emit no light.

Accordingly, a known analogue circuit can use the driving signal which is the digital signal of high and low to drive a plurality of light sources provided to the light source unit 30 in sequence. Also, since a known analogue circuit is used, the circuit is simple and cost can be reduced.

Also, besides the driving signal having a previously programmed waveform, the driving signal having a waveform necessary to a circumstance can be appropriately generated through the simple analogue circuit, thereby driving a plurality of light sources provided to the backlight unit.

The diode unit 43 according to the present exemplary embodiment is provided as a reverse direction diode. Alternatively, the diode unit 43 may be provided as a forward direction diode. In this case, if the voltage level of the driving signal generated by the driving signal generating unit 15 is the low level, the diode unit 43 is opened, and the light source unit 30 emits light. If the voltage level is the high level, the diode unit 43 is connected, and the light source unit 30 emits no light.

As described above, exemplary embodiments of the present invention provide a backlight unit and a display apparatus having the same using a simple and inexpensive analogue circuit in driving a plurality of light sources provided to a backlight unit in sequence.

Also, exemplary embodiments of the present invention provide a backlight unit and a display apparatus having the same using a digital signal of high and low so that an analogue circuit can drive a plurality of light sources of a backlight unit in sequence.

Also, exemplary embodiments of the present invention provide a backlight unit and a display apparatus having the same appropriately generating a driving signal having a waveform necessary to a circumstance in addition to a driving signal having a previously programmed waveform through a simple analogue circuit, thereby driving a plurality of light sources provided to a backlight unit.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus comprising:

a display unit which displays a video;

a light source unit which comprises a plurality of light sources which are independently driven and illuminate the display unit; and a driving unit which drives the light source unit, the driving unit comprising:

a driving signal generating unit which generates a driving signal having a first voltage level and a second voltage level so that the plurality of light sources can be independently driven, and a control unit which blocks the driving signal to the light source unit based on a voltage level which is sensed from a current of the light source unit if the driving signal generated by the driving signal generating unit is the first voltage level, and which applies the driving signal to drive the light source unit based on the voltage level which is sensed from a current of the light source unit if the driving signal generated by the driving signal generating unit is the second voltage level.

2. The display apparatus according to claim 1, wherein the control unit comprises a diode unit.

3. The display apparatus according to claim 2, wherein the diode unit comprises a reverse direction diode, and which blocks the driving signal to drive the light source unit based on the voltage level which is sensed from a current of the light source unit if the first voltage level of the driving signal is a high level.

4. The display apparatus according to claim 2, wherein the diode unit comprises a forward direction diode, and blocks the driving signal to drive the light source unit based on the voltage level which is sensed from a current of the light source unit if the first voltage level of the driving signal is a low level.

5. The display apparatus according to claim 2, wherein the diode unit comprises a same number of diodes as a number of the light sources which are provided to the light source unit.

6. The display apparatus according to claim 3, wherein the diode unit applies the driving signal to drive the light source unit based on the voltage level which is sensed from a current of the light source if the second voltage level of the driving signal is a low level.

7. The display apparatus according to claim 4, wherein the diode unit applies the driving signal to drive the light source unit based on the voltage level which is sensed from a current of the light source unit if the second voltage level of the driving signal is a high level.

8. The display apparatus according to claim 1, wherein the plurality of light sources are arranged in a matrix shape.

9. A backlight unit comprising:

a light source unit which comprises a plurality of light sources which are independently driven; and a driving unit which drives the light source unit, the driving unit comprising:

a driving signal generating unit which generates a driving signal having a first voltage level and a second voltage level so that the plurality of light sources can be independently driven, and a control unit which blocks the driving signal to the light source unit based on a voltage level which is sensed from a current of the light source unit if the driving signal which is generated by the driving signal generating unit is the first voltage level, and which applies the driving signal to drive the light source unit based on the voltage level which is sensed from a current of the light source unit if the driving signal generated by the driving signal generating unit is the second voltage level.

10. The display apparatus according to claim 9, wherein the control unit comprises a diode unit.

11. The backlight unit according to claim 10, wherein the diode unit comprises a reverse direction diode, and blocks the driving signal to drive the light source unit based on the voltage level which is sensed from a current of the light source unit if the first voltage level of the driving signal is a high level.

12. The backlight unit according to claim 10, wherein the diode unit comprises a forward direction diode, and blocks the driving signal to drive the light source unit based on the voltage level which is sensed from a current of the light source unit if the first voltage level of the driving signal is a low level.

13. The backlight unit according to claim 10, wherein the diode unit comprises a same number of diodes as a number of the light sources which are provided to the light source unit.

14. The backlight unit according to claim 11, wherein the diode unit applies the driving signal to drive the light source unit based on the voltage level which is sensed from a current of the light source if the second voltage level of the driving signal is a low level.

15. The backlight unit according to claim 12, wherein the diode unit applies the driving signal to drive the light source unit based on the voltage level which is sensed from a current of the light source unit if the second voltage level of the driving signal is a high level.

16. The backlight unit according to claim 9, wherein the plurality of light sources are arranged in a matrix shape.

* * * * *